US006349779B1

(12) United States Patent
Gilbert

(10) Patent No.: US 6,349,779 B1
(45) Date of Patent: Feb. 26, 2002

(54) PROFILED ELEMENT FOR ROTARY DRILLING EQUIPMENT AND DRILL ROD COMPRISING AT LEAST ONE PROFILED PORTION

(75) Inventor: Boulet Jean Gilbert, Paris (FR)

(73) Assignee: S.M.F. International, Cosne sur Loire (FR)

( * ) Notice: Subject to any disclaimer, the term of this patent is extended or adjusted under 35 U.S.C. 154(b) by 0 days.

(21) Appl. No.: 09/497,197

(22) Filed: Feb. 3, 2000

(30) Foreign Application Priority Data

Feb. 5, 1999 (FR) ..... 99 01391

(51) Int. Cl.[7] ..... E21B 17/22
(52) U.S. Cl. ..... 175/323; 175/394; 138/177
(58) Field of Search ..... 175/323, 102, 175/394, 320; 166/242.1; 138/113, 177, DIG. 11

(56) References Cited

U.S. PATENT DOCUMENTS

| | | | | |
|---|---|---|---|---|
| 4,729,438 A | | 3/1988 | Walker et al. | |
| 4,874,045 A | * | 10/1989 | Clayton | 175/57 |
| 4,984,633 A | | 1/1991 | Langer | |
| 5,096,344 A | * | 3/1992 | Fischer | 408/230 |
| 5,937,957 A | * | 8/1999 | Swietlik | 175/323 |

FOREIGN PATENT DOCUMENTS

| | | |
|---|---|---|
| DE | 29 20 140 | 4/1981 |
| EP | 178 709 | 9/1985 |
| EP | 654 583 | 5/1995 |
| EP | 866 209 | 9/1998 |

* cited by examiner

*Primary Examiner*—David Bagnell
*Assistant Examiner*—Zakiya Walker
(74) *Attorney, Agent, or Firm*—Sughrue Mion, PLLC

(57) ABSTRACT

The profiled element or portion (3) exhibits a shape which is overall of revolution with straight or curved generatrices and an axis directed along the axis of rotation of drilling. It includes projecting parts or ribs (14, 15, 20) and recessed parts or grooves (13, 16, 19) arranged in helixes with, as their axis, the axis of the rotary drilling. Over at least part (10, 11) of the length of the profiled element (3) in the axial direction, at least one of the geometric and dimensional characteristics of the recessed parts (13, 16, 19) and of the projecting parts (14, 15, 20) varies in the axial direction of the profiled element (3). As a preference, the profiled element (3) includes, in at least one variable profiled part (11), passages in the shape of grooves (16) with a cumulative cross section which decreases in a direction of flow of the drilling fluid. This thus yields a hydrodynamic bearing effect, by forming a circumferential leakage flow (18) of the drilling fluid.

18 Claims, 7 Drawing Sheets

PROFILED ELEMENT FOR ROTARY DRILLING EQUIPMENT AND DRILL ROD COMPRISING AT LEAST ONE PROFILED PORTION

The invention relates to a profiled element for rotary drilling equipment and, in particular, to a profiled portion of a rod of a rotary drill rod string.

In the field of prospecting for and production from oil deposits, use is made of rotary drill rod strings made up of rods and possibly other tubular elements which are joined together end to end as required for the drilling.

Such strings of rods may, in particular, make it possible to make deflected drillings, that is to say drillings whose incidence with respect to the vertical or the direction in terms of azimuth can be varied during drilling.

In the case of deflected drillings with a large offset including horizontal or practically horizontal portions, the friction couples due to the rotation of the drill lining may reach extremely high values during drilling. The friction couples may jeopardize the equipment used or the objectives of the drilling. Furthermore it is often difficult to bring up the debris produced by the drilling, given the sedimentation of the debris that occurs in the borehole, particularly in the steeply inclined part of the borehole. This results in poor cleaning of the hole and an increase both in the coefficients of friction of the rods of the string of rods inside the borehole and of the areas of contact between the rods and the walls of the hole.

In order to reduce the coefficient of friction and the area of contact between the string of rods and the walls of the borehole and to improve the cleaning of the borehole and the removal of debris in the drilling fluid, there has been proposed, in patent application FR-97/03207, a drill rod comprising at least one bearing region which has a central bearing part and two end portions, one on each side of the central bearing region and comprising, on their external surface, at least one groove arranged in a helix and the transverse cross section of which has an undercut part. The bearing region of the drill rod, which has a diameter greater than the diameter of the end portions, comes into contact with the wall of the borehole and provides a certain reduction in the friction between the drill rod and the wall of the borehole. The end parts which comprise hydraulic profiles allow flow of drilling fluid to be activated and allow debris attached to the wall of the borehole to be detached.

The bearing parts of the drill rod generally comprise grooves which allow the drilling fluid to pass between the bearing parts and the wall of the borehole. The drilling fluid flowing through these grooves in an axial direction has practically no effect in reducing the friction between the bearing parts of the drill rod and the wall of the hole. The effect that the bearing parts of the drill rod has on reducing the friction is therefore limited.

Bearings are known in which the friction can be reduced down to very low levels, by the hydrodynamic effect of a fluid circulated between the rubbing surfaces of the bearing. In the case of the profiled drill rod string elements known from the prior art and as described, for example, in FR 97 03207, such hydrodynamic effects of the drilling fluid between the bearing surfaces of the drill rod and the wall of the hole have not been able to be obtained. In general, numerous elements for drilling equipment are known, including drill rods with a cylindrical overall shape, that is to say exhibiting a cylindrical external envelope surface, which comprise projecting parts and recessed parts on their external surface which are arranged in helixes with, as their axis, the axis of rotation of the drilling equipment. Such profiled shapes including projecting parts and recessed parts in helixes make it possible, in particular, to improve the flow of the drilling fluid in the annular space delimited between the equipment and the borehole. However, these profiled elements, the transverse cross section of which is constant along the longitudinal axial direction of the drilling equipment and the diameter of which is smaller than the diameter of the borehole, provide no solution regarding the production of low-friction bearings for guiding the equipment or the drill rod.

What is more, when tension is exerted on drilling equipment, such as a string of rods, to raise it back to the surface, blockages may occur on account of the drilling equipment becoming jammed by debris or roughnesses projecting from the wall of the borehole. It may be very difficult if not impossible to unblock and therefore raise the drilling equipment. The recessed or projecting helix-shaped parts present on the exterior surface of certain drilling equipment such as drill rods do not generally provide any solution to this problem or, on the contrary, increase the risk of jamming.

The object of the invention is therefore to provide a profiled element for rotary drilling equipment, exhibiting a shape which is overall of revolution and an axis directed along the axis of rotation of drilling, and parts which project and parts which are recessed in radial directions on its external surface, in arrangements which are roughly in the shape of helixes with, as their axis, the axis of rotation of the drilling equipment, this profiled element making it possible, in particular, to reduce the friction between the drilling equipment and a wall of a borehole and to limit the risks of the drilling equipment jamming when raising the equipment back up inside the borehole.

To this end, over at least part of the length of the profiled element in the axial direction, at least one of the geometric and dimensional characteristics of the recessed parts and of the radial projecting parts varies in the axial direction of the element.

In order to make the invention easy to understand, one embodiment of drilling equipment consisting of a drill rod including a number of profiled portions according to the invention will now be described by way of non-limiting example with reference to the appended figures.

Figure 1:
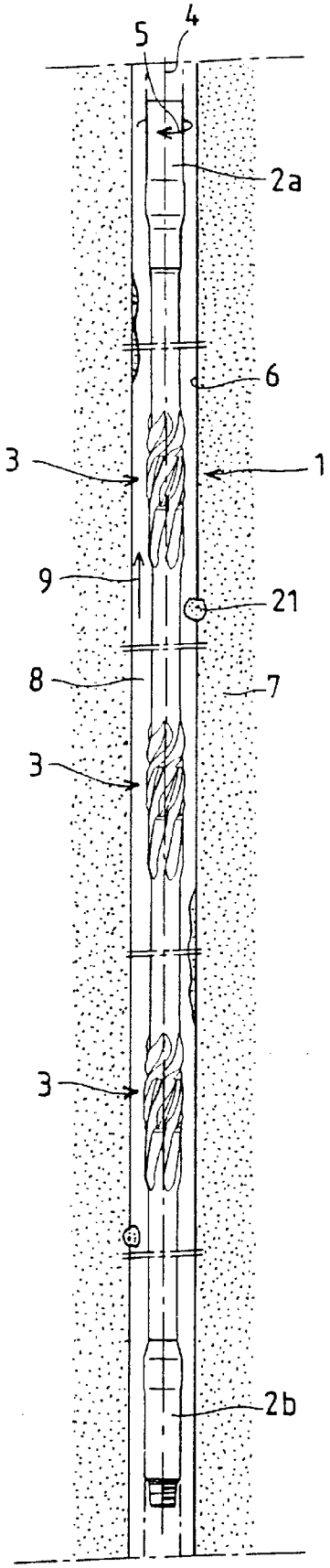
FIG. 1 is a view in side elevation of a drill rod including, along its length, a number of profiled portions according to the invention.

FIG. 1 depicts a drill rod denoted overall by the reference 1 and constituting one element of a drill rod string in which the successive drill rods may be connected by screwing their end parts together. The rod 1 includes an upper end part 2*a* constituting a female screwed connection element and a lower end part 2*b* constituting a male screwed connection element. The threaded part of the male connection element 2*b* of frustoconical shape is intended to be engaged by screw-fastening in an upper end connection part of a drill rod, similar to the part 2*a* of the rod 1 and comprising a tapped part of frustoconical shape.

The rod 1 includes at least one and, for example, three profiled portions 3 of identical shape which are produced according to the principle of the invention.

The profiled portions 3, the external surface of which is of revolution with straight or curved generatrices, are distributed along the length of the drill rod 1, approximately at equal distances from one another in the axial longitudinal direction of the drill rod.

As will be explained later on, the upper 2*a* and lower 2*b* end parts of the drill rod may also include variable profiled parts produced according to the principle of the invention.

The drill rod exhibits an overall cylindrical tubular shape, the envelope of the external surface of the rod being a cylinder, with an outside diameter which varies according to the successive portions of the drill rod. The drill rod 1 has an axis 4 about which the rod is rotated in the direction indicated by the closed curved arrow 5 when the rod is connected to a string of rods carrying out the rotary drilling of a hole 6 inside a geological formation 7.

During drilling, a drilling fluid flows from the top downwards inside the string of rods as far as the drilling tool connected to the rod of the rod string which is located furthest down in the bottom of the borehole 6. The drilling fluid then flows from the bottom upwards, from the bottom of the hole 6, in the annulus 8 of the borehole, that is to say in the annular space that lies between the string of rods and the wall of the hole 6. An arrow 9 has been used to indicate the flow of drilling fluid in the annulus 8 around the rod 1.

Figure 2:
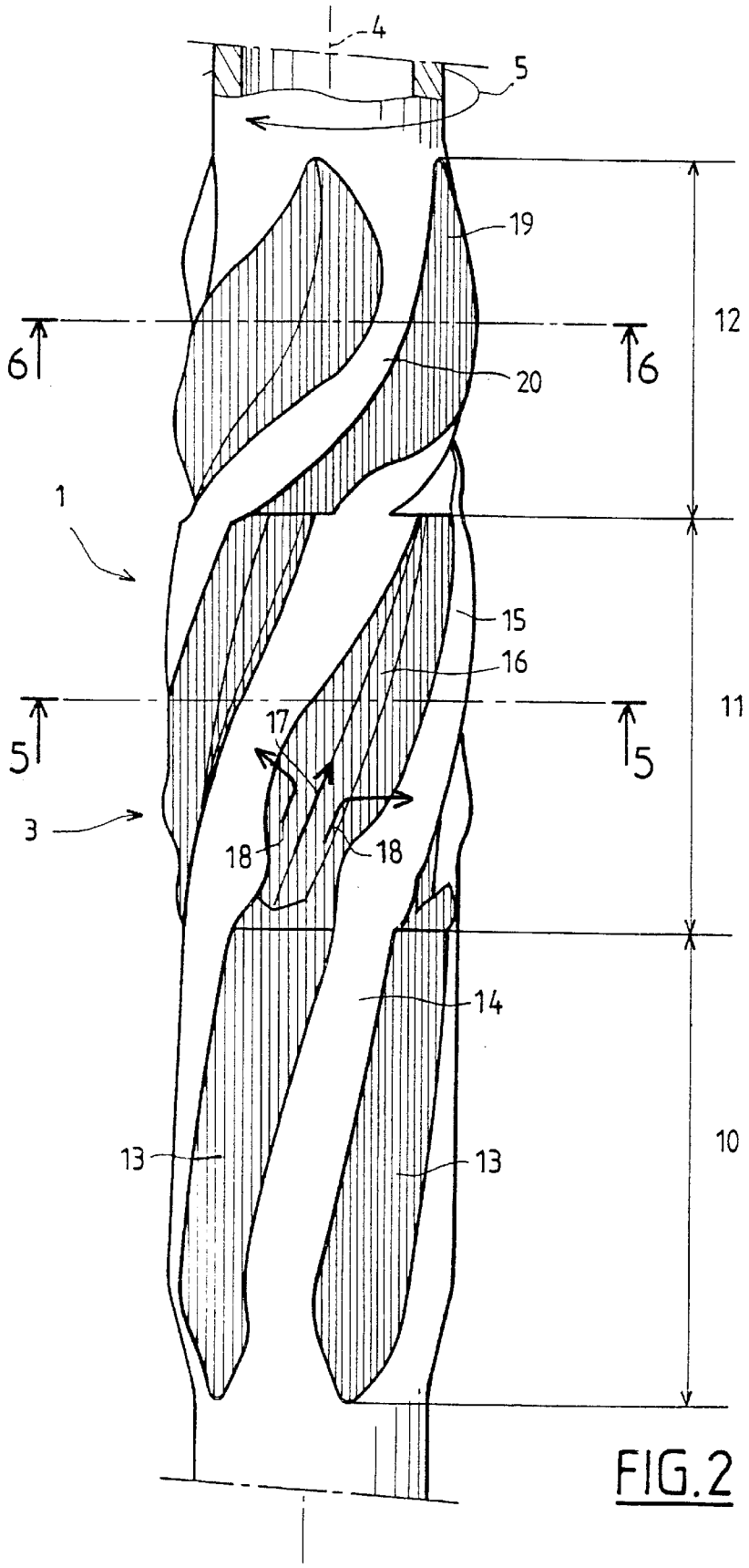
FIG. 2 is a view in elevation on a larger scale of a profiled portion of the drill rod depicted in FIG. 1.

FIG. 2 depicts a profiled portion 3 of the drill rod 1, which includes three successive parts 10, 11 and 12 arranged one after the other in the axial direction 4 of the drill rod, from the bottom upwards.

The lower part 10 of the profiled portion 3 is produced in accordance with French application 97/03207 and includes recessed parts or grooves 13 arranged in helixes with, as their axis, the axis 4 of the drill rod 1, of which the transverse cross section on a plane perpendicular to the axis 4 of the drill rod exhibits an undercut part located to the rear of the groove when considering the direction of rotation 5 of the drill rod. Thus, as the drill rod rotates, the profiled part 10 optimally activates the flow of the drilling fluid and the drilling debris in the borehole annulus 8. The cleaning of the annulus is thus considerably improved and friction between the string of rods and the borehole is reduced, as has been explained in the aforementioned patent application. The profile 10 including recessed parts consisting of the grooves 13 and of the projecting parts 14 separating the grooves 13 exhibits geometric and dimensional characteristics which are approximately uniform along the length of the profiled part 10. The grooves 13 and the projecting ribs 14 have essentially constant widths in the circumferential direction and the inclination of the helixes formed by the grooves 13 and the ribs 14 is constant in the axial direction of the rod 4.

The uniform cross section profiled part 10 which is not in contact with the wall of the borehole and which is not produced according to the invention is not able to convert axial movements or loadings into circumferential movements or loadings on account of a dimensional or geometric modification to the recessed or projecting profiles arranged in helixes.

By contrast, the two successive upper parts 11 and 12 of the profiled portion 3 of the drill rod, which will be described hereinafter, exhibit axially variable shapes according to the invention.

The part 10 produced according to patent application Ser. No. 97/03207 may, however, be usefully combined with the parts 11 and 12 produced according to the invention in order to obtain better results.

Figure 3:
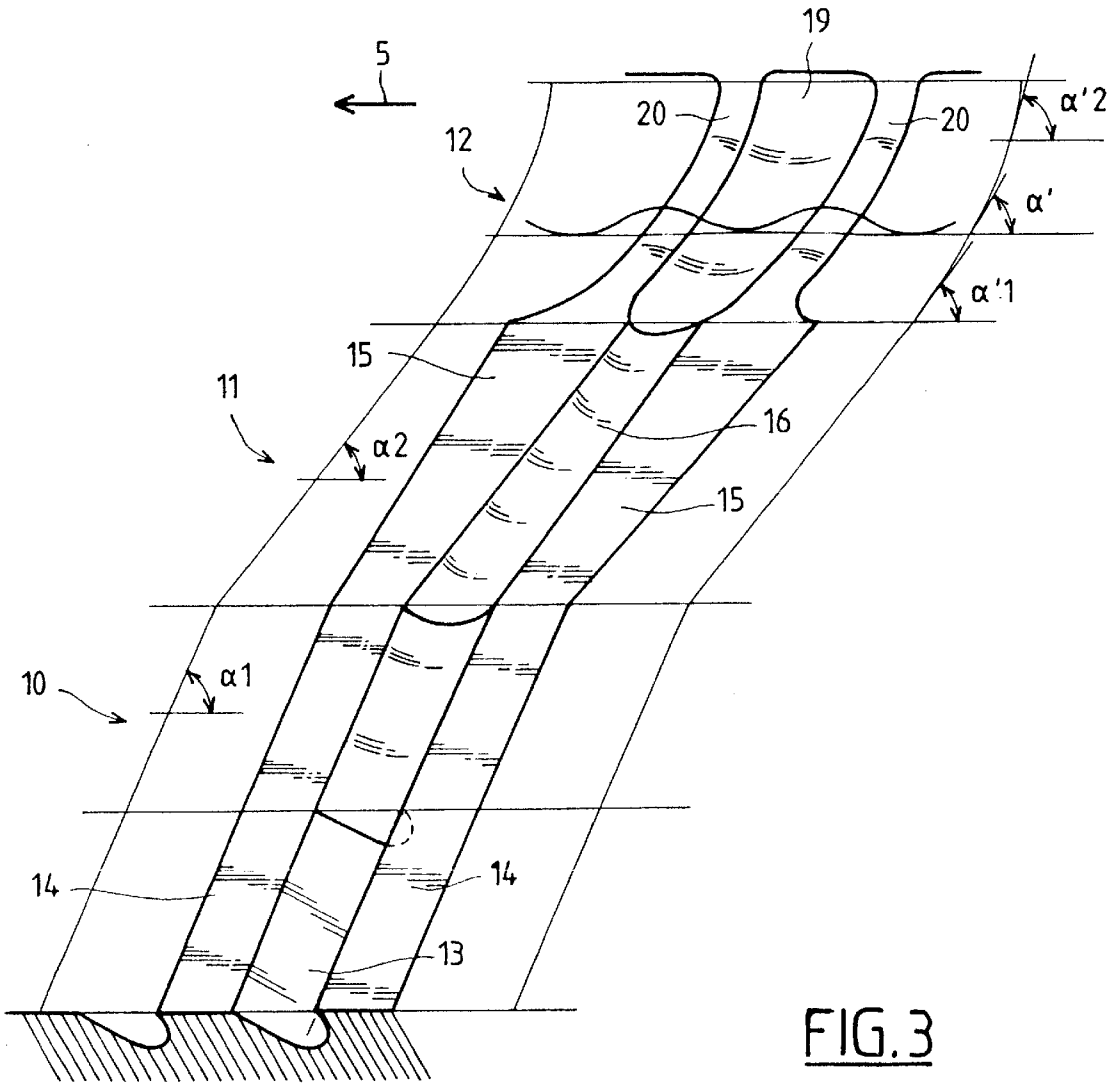
FIG. 3 is a development in the circumferential direction of part of the profiled portion depicted in FIG. 2.

FIG. 3 depicts a development in the circumferential direction of the two profiled parts 11 and 12. The variable profiled part 11 of the portion 3 of the drill rod includes radial projecting parts or ribs 15 and recessed parts or grooves 16 each arranged between two radial projecting parts 15.

Both the radial projecting parts 15 and the recessed grooves 16 are arranged in helixes with, as their axis, the axis 4 of the rod 1.

The profiled part 11 of the portion 3 of the drill rod includes, for example, five projecting parts 15 arranged in five helixes having, as their axis, the axis 4, and separated one from the next by five grooves 16 which are also arranged in five helixes with, as their axis, the axis 4 of the drill rod.

As depicted in FIG. 3, each of the projecting ribs 15 is arranged in the continuation of a projecting rib 14 of the profiled part 10 of the portion 3. Likewise, each of the grooves 16 of the profiled part 11 is arranged in the continuation of a groove 13 of the profiled part 10 of the portion 3.

The helixes in which the ribs 14 and the grooves 13 of the profiled part 10 are arranged have an angle of inclination $\alpha_1$, with respect to the transverse plane perpendicular to the axis 4 of the string of rods. The ribs 15 and the grooves 16 of the profiled part 11 are arranged in helixes which have an angle of inclination $\alpha_2$ with respect to the transverse plane perpendicular to the axis 4 of the drill rod.

The profiled parts 10 and 11 are produced in such a way that the angle $\alpha_1$ is greater than the angle $\alpha_2$. Furthermore, according to the invention, the grooves 16 of the profiled part 11 have a width in the circumferential direction which decreases in the axial direction of the drill rod and in the direction from the bottom upwards, that is to say in the direction in which the drilling fluid flows in the annulus 8. Correspondingly, the projecting ribs 15 of the profiled part 11 have a width in the circumferential direction which increases in the axial direction of the drill rod and in the direction from the bottom upwards.

Figure 4:
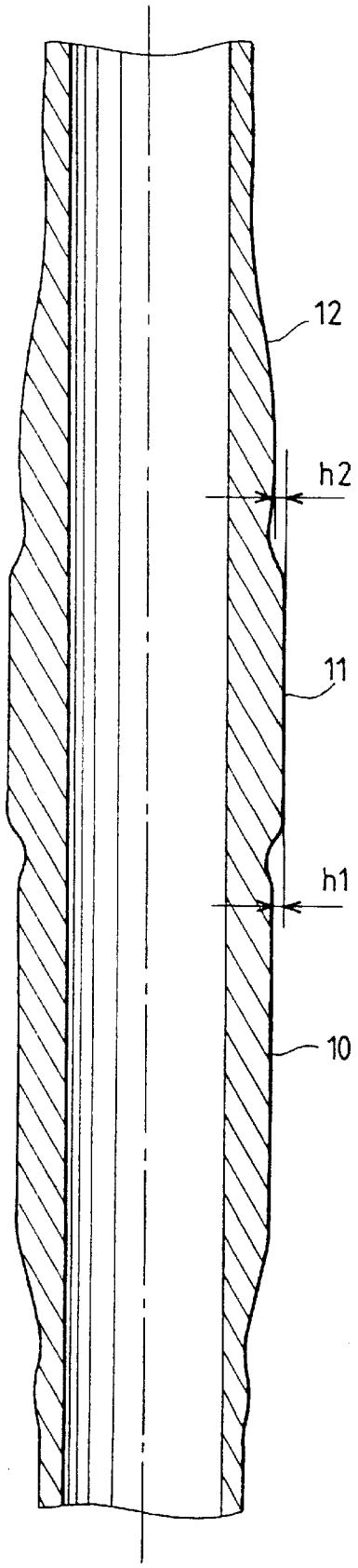
FIG. 4 is a view in axial section of the profiled portion depicted in FIG. 2.

What is more, as can be seen in particular in FIG. 2 and in figure 4 showing an axial section of the profiled portion 3 of the rod 1, the rod 1 exhibits, at the variable profiled part 11, a maximum outside diameter which is greater than the outside diameter of the profiled parts 10 and 12 placed on each side of the variable profiled part 11. The maximum outside diameter of the profiled part 11 is not much smaller than the inside diameter of the borehole 6, which means that the annulus 8 is of small radial width in the region of the profiled part 11.

Figure 5:
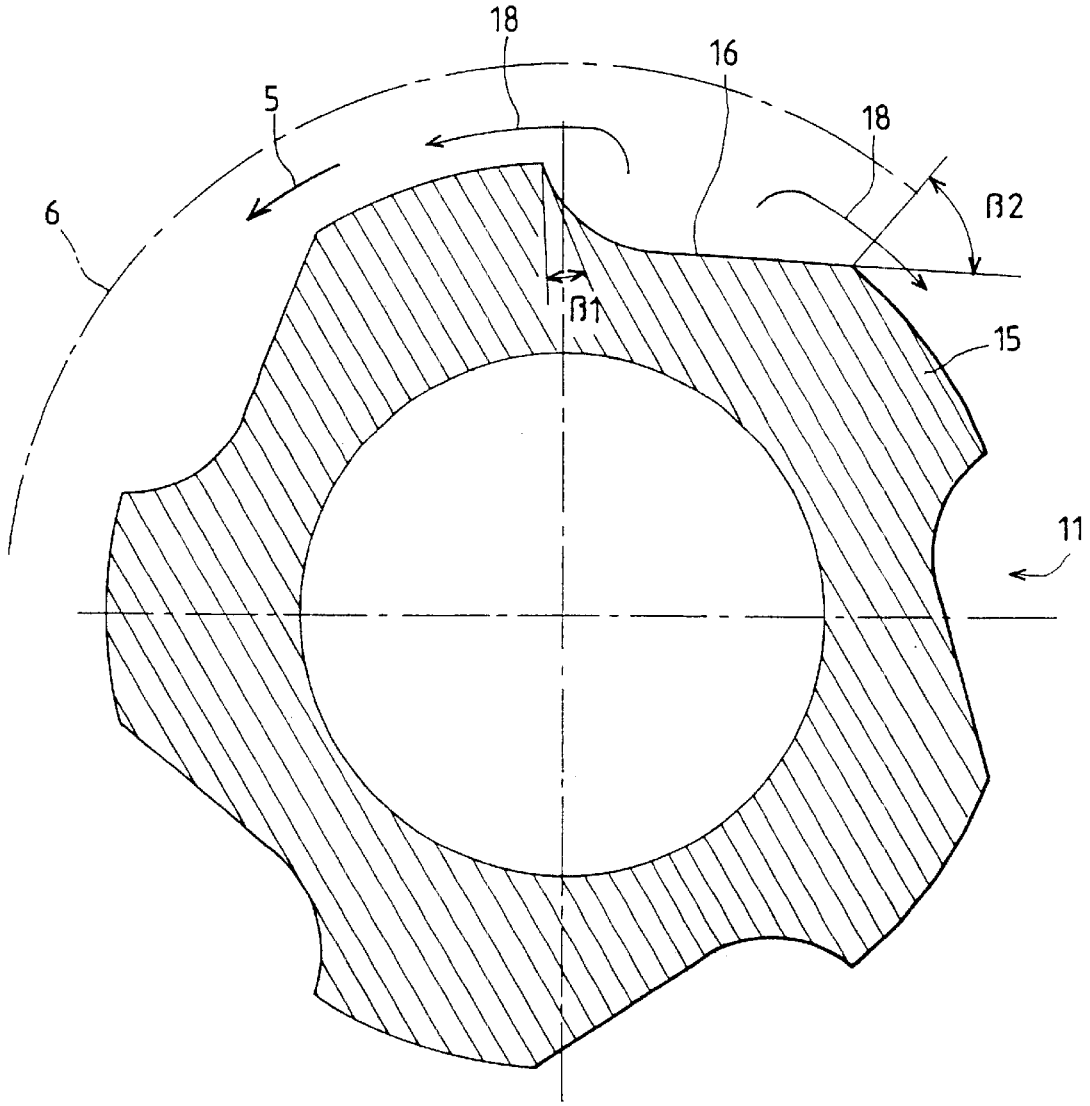
FIG. 5 is a view in transverse cross section on 5—5 of FIG. 2.

FIG. 5 shows a transverse cross section of the variable profiled part 11 which, along the circumference of the drill rod, has five radial projecting parts 15 or ribs separated one from the next by a recessed part or groove 16. The transverse cross sections of the grooves 16 may exhibit an asymmetric shape, the inclination of the leading edge of the groove 16 in the direction of rotation given by the curved arrow 5 differing from the angle of inclination of the trailing edge. In the scenario depicted in FIG. 5, the tangent to the leading edge of the transverse section of the groove 16 makes an angle $\beta 1$ with the radius of the drill rod ending at the tip of the leading edge. The tangent to the trailing edge makes an angle $\beta 2$ with the radius of the drill rod ending at the tip of the trailing edge. In the scenario depicted, $\beta 1$ is smaller than $\beta 2$, which seems to be a favourable design for obtaining a hydrodynamic bearing effect between the profiled part 11 of the drill rod and the wall of the borehole 6.

The drilling fluid flowing through the annulus during drilling, in the direction from the bottom upwards, is guided by the grooves 16, in the region of the profiled part 11 of the portion 3. The drilling fluid is guided upstream of the profiled part 11 by the grooves 13 of the profiled part 10. Because the grooves 16 of the profiled part 11 are in the continuation of the grooves 16 of the profiled part, the grooves 16 are supplied with drilling fluid from the grooves 13.

An arrow 17 has been used in FIG. 2 to indicate the flow of the drilling fluid through one of the grooves 16 in the profiled part 11. Because the width and therefore the cross section of the groove 16 decreases in the direction in which the drilling fluid flows, deflected circumferential streams 18 gradually arrive out of the flow of the drilling fluid, forming leakage streams.

As depicted in FIG. 5, the leakage streams 18 of drilling fluid arrive between the wall of the borehole 6 and the exterior surface of the profiled part 11 of the drill rod. This then yields a hydrodynamic bearing effect, from the circumferential streams of fluid which are throttled between the exterior surface of the profiled part 11 of the drill rod and the wall of the borehole 6. In this way, the friction between the drill rod and the wall of the borehole is considerably reduced in the bearing regions consisting of the variable profiled parts 11, the outside diameter of which is greater than the diameter of the adjacent profiled parts of the rod and the main parts of the rod located between the profiled portions.

Figure 6:
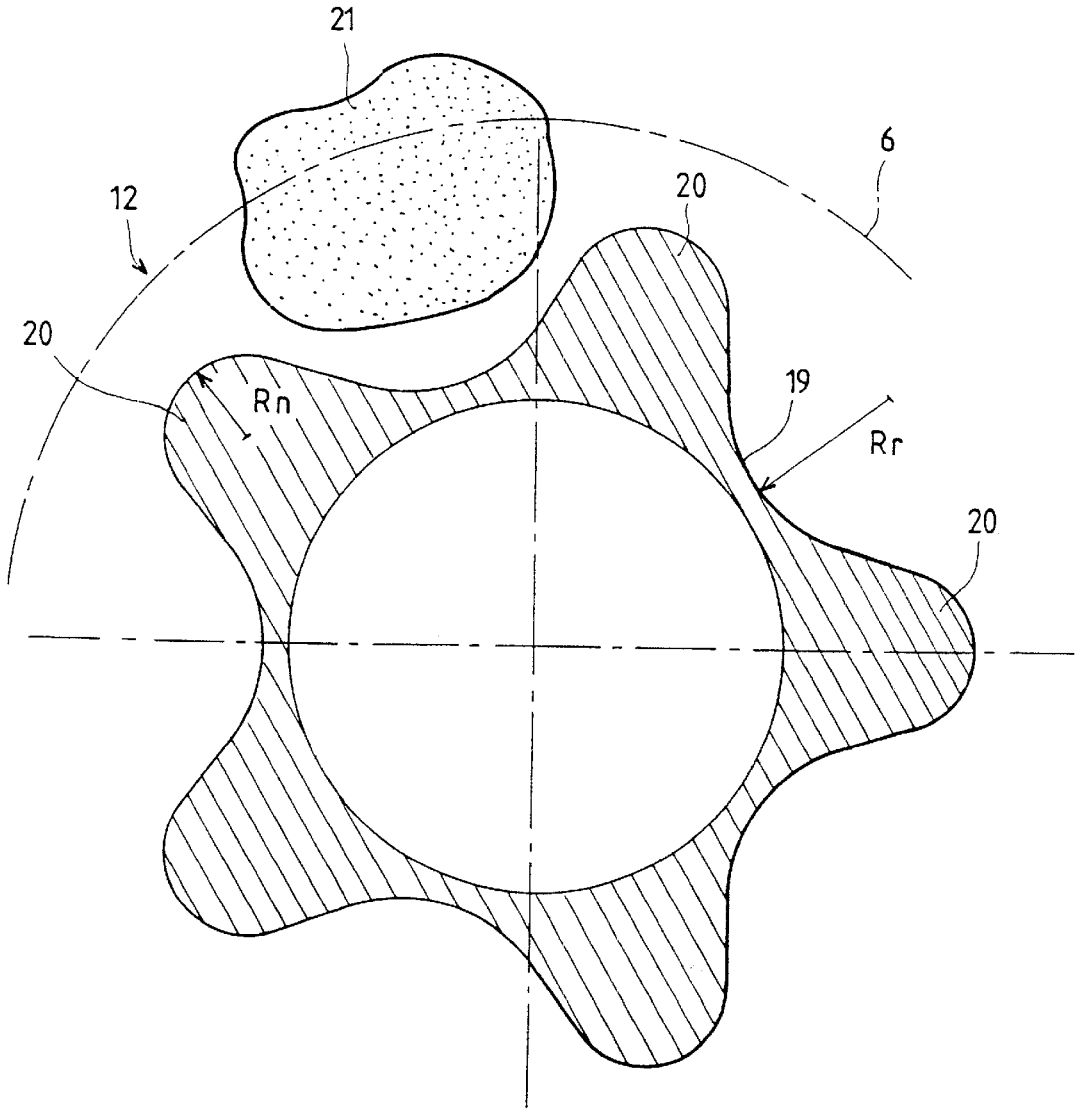
FIG. 6 is a view in transverse cross section on 6—6 of FIG. 2.

As can be seen in FIGS. 2, 3 and 6, the upper profiled part 12 of the profiled portion 3 of the drill rod includes radial projecting ribs 20 separated one from the next by recessed parts or grooves 19.

The radial projecting ribs 20 are arranged in the continuation of the ribs 14 and 15 of the respective profiled parts 10 and 11 of the drill rod. The recessed parts 19 are in the continuation of the grooves 13 and 16 of the profiled parts 10 and 11.

The ribs 20 are arranged in helixes with, as their axis, the axis 4 of the drill rod, the angle of inclination $\alpha'$ of which varies continuously between a minimum value $\alpha'1$ and a maximum value $\alpha'2$, less than or equal to 90° when moving from the bottom upwards.

As can be seen in FIG. 6, the variable profiled part 12 of the portion 3 of the drill rod has five successive ribs 20 separated one from the next by a recessed part 19. The transverse cross section of the ribs 20 includes an approximately circular external end part of radius $R_n$ and the grooves 19 exhibit an internal or bottom part of essentially circular shape with a radius $R_r$.

As the drill rod string is raised up by pulling on its end located at the surface, each of the rods of the drill rod string such as the rod 1 is liable to come into contact with an obstacle such as debris or an area of roughness 21 (depicted in FIGS. 1 and 6) projecting towards the inside with respect to the wall of the borehole 6. The projecting obstacle 21 is liable to cause the drill rod to become blocked and jammed as it is being raised.

The presence of a profiled part 12 of variable inclination on the drill rod coming into contact with the obstacle 21 while the rod subjected to axial tension is being raised encourages unblocking of the rod. Specifically, as the rod is pulled in the axial direction, the roughness or obstacle 21 is guided by the ribs 20 of the profiled part 12 which act as guide rails on each side of the obstacle 21.

The obstacle 21 in contact with a recessed part of the profile 12 exerts on this profile a twisting couple of increasing magnitude because the angle of inclination of the helixes in which the ribs 20 are arranged, with respect to a horizontal transverse plane, decreases from the top downwards. The couple exerted by the obstacle on the profiled part 12 of the drill rod causes the drill rod to twist slightly and causes the rod to move in the borehole, which allows the rod to unblock.

The angle of inclination $\alpha'$ of the ribs 20 varies continuously in the axial direction, changing from a value $\alpha1$ at the lower end of the profiled part 12 to a value $\alpha2$ close to 90° at the upper end of the profiled part 12. Thus, as the rod is pulled in order to raise it up inside the hole, the obstacle 21 projecting from the wall of the hole easily engages between the ribs 20 at the upper end of the profiled wall 12 and can be guided in a groove 19, facilitating sliding.

Figure 7:
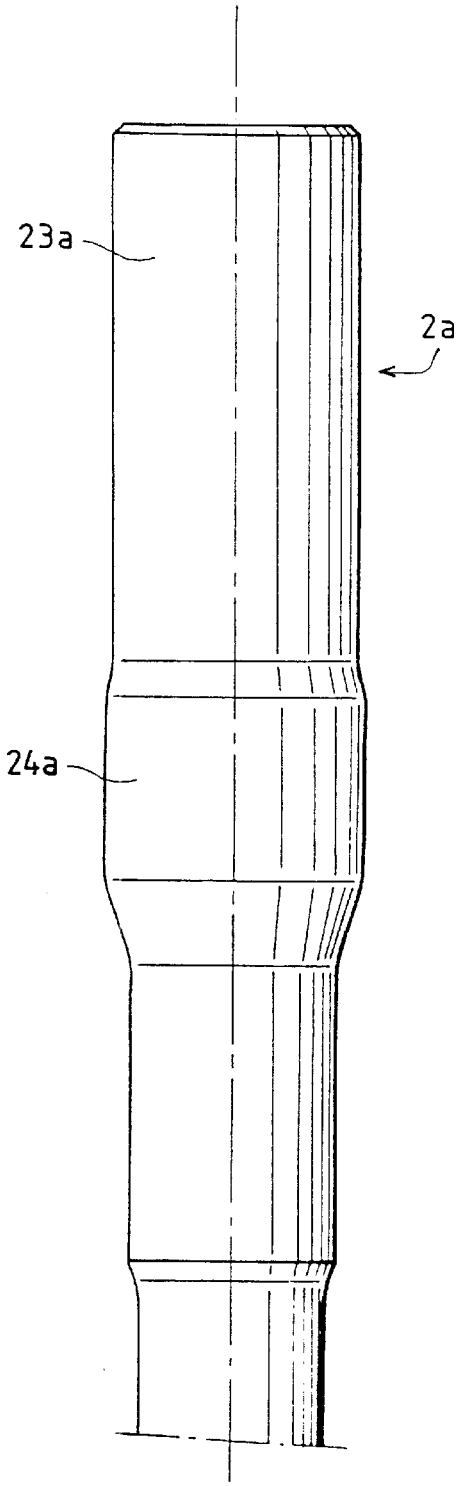
FIG. 7 and FIG. 8 are detail views of the ends of the drill rod constituting screw-fastening elements.
Figure 8:
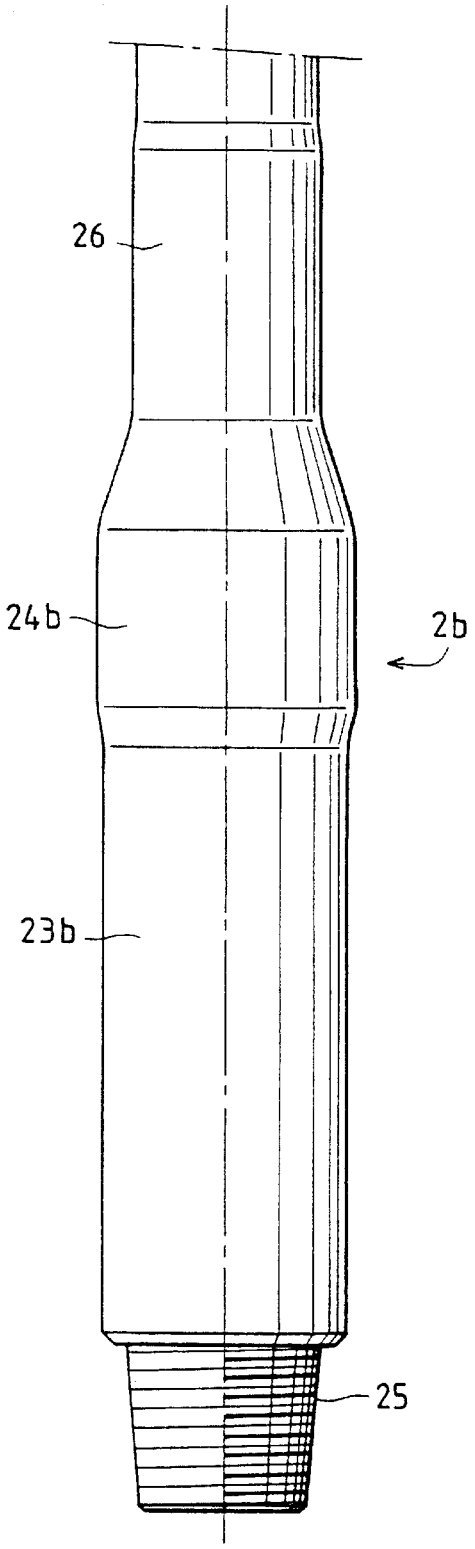

As visible in FIGS. 7 and 8, the upper and lower end parts, 2*a* and 2*b* respectively, of the drill rod include two successive parts 23*a* and 24*a* or 23*b* and 24*b* exhibiting slightly different diameters.

The smaller-diameter walls 23*a* and 23*b* of the connection ends 2*a* and 2*b* of the drill rod include the threaded parts for connecting the rod, such as the male part of frustoconical shape 25 visible in FIG. 8. The smaller-diameter part 23*a* of the upper end 2*a* has a tapped internal bore of frustoconical shape able to take a threaded end of frustoconical shape belonging to a second drill rod analogous to the threaded frustoconical part 25 depicted in FIG. 8.

Because of the difference in diameter between the parts 23*a* and 24*a* or 23*b* and 24*b* of the ends of the drill rod, these ends are liable to come into contact with the wall of the borehole 6 via the larger-diameter parts 24*a* and 24*b*. The parts 23*a* and 23*b* including the connection screwthreads are thus protected during rotary drilling.

The larger-diameter part 24*a* or 24*b* of the connection end of the drill rod may have ribs and grooves similar to the ribs and grooves 15 and 16 of the variable profiled part 11 described earlier in the case of a profiled portion arranged in part of the drill rod partway between these ends.

When the parts 24*a* and 24*b* of the ends of the drill rod have grooves such as the grooves 16 with a cross section that decreases in the direction of flow of the fluid inside the borehole, a hydrodynamic bearing effect is obtained at the ends of the drill rod, and this makes it possible to reduce the friction in these end parts.

To make the drill rod easier to extract and to avoid jamming while the rod is being raised up inside the borehole, it is possible to provide profiles analogous to the variable profile of the part 12 described above on certain end parts of the rod and, in particular, on a portion 26 of the drill rod adjacent to the large diameter portion 24*b* of the lower connection end 2*b* of the rod, the portion 26 being arranged just above the portion 24*b*.

As regards the overall arrangement of the profiled portions on the drill rod 1, it is preferable to provide one or more profiled portions, for example one, two or three profiled portions according to the length of the drill rod, each of the profiled portions exhibiting a shape analogous to the portions 3 described hereinabove. Each of the profiled portions preferably includes a profile for cleaning the borehole analogous with the profile 10, a variable profile analogous with the profile 11 including the grooves whose cross section decreases in the direction of flow of the drilling fluid, so as to obtain a hydrodynamic bearing effect, and a variable profile analogous with the profile 12 making the drill rod easier to extract. The three profiles 10, 11 and 12 must be arranged in this order, in the direction of flow of the drilling fluid. The Archimedian screw effect of the debris-cleaning profile 10 makes it possible to activate the flow of the drilling fluid upstream of the profile 11 the grooves 16 of which are thus effectively supplied with drilling fluid, thus improving the hydrodynamic bearing effect of the profile 11.

The profile 12 allows the profiled parts 10 and 11 to be protected while the drill rod is being extracted, the obstacles being guided between the grooves 20 of the profile 12 and causing the drill rod to rotate slightly, allowing it to be freed.

As visible in FIG. 4, the profiled parts 11 exhibit an outside diameter that is greater than the maximum outside diameter of the profiled parts 10 and 12. The diameter of the profiled parts 11 constitutes the maximum diameter of the drill rod which means that the drill rod bears against the walls of the borehole via the profiled parts 11 constituting hydrodynamic bearings.

The profiles 10 and 12 exhibit a maximum outside radius that is smaller by h1 or h2 than the maximum outside radius of the profiled parts 11. Thus, the profiled parts 10 and 12 are not likely to come into contact with the wall of the borehole. The profiled parts 10 ensure that the flow of the drilling fluid is activated in the annulus and that debris is detached and carried along.

The profiles 10 and 12 may also exhibit an outside radius more or less equal to the radius of the profiled parts 11 ($h_1$, and $h_2$ =0).

The end parts such as 2*a* and 2*b* of the drill rod and the ribs 15 may be covered with a layer of a hard material such as tungsten carbide and include large-diameter portions 24*a* and 24*b*, the diameter of which is little smaller than or is equal to the diameter of the profiled parts 11, this diameter constituting the maximum diameter of the drill rod. Thus, the drill rod may bear at it ends against the wall of the borehole via the wear-resistant parts 24*a* and 24*b*.

In a drill rod string, it is possible to use drill rods which have profiled parts as described above and plain drill rods which have no such profiled parts. For example, it is possible to envisage the use of just one profiled drill rod for every three rods joined together end to end when making up the drill rod string.

In any event, the presence of profiled elements according to the invention in drilling equipment such as a drill rod string allows a considerable improvement in the rotary drilling conditions. In particular, the use of profiled elements according to the invention makes it possible to reduce the rotational torque of the string of rods, to improve the properties of multidirectional sliding between the walls of the borehole and the string of rods, to reduce the axial loadings and the risks of blockage when raising the string of rods back up to the surface, to reduce the risk of the string of rods becoming stuck through differential pressure inside the borehole and to improve the mechanical behaviour of the string of rods (or of any other drilling equipment or lining).

The improvement in the mechanical behaviour of the drill rod string is due, in particular, to the improvement in the slipping properties and in the geometric quality of the bearing surfaces between the string of rods and the walls of the borehole. The amplitude of the modes of vibration of the drill rod is thus decreased and the risks of stick and slip of the drill tool are reduced. In general, the transmission of the weight of the string of rods to the drilling tool is improved by limiting the friction between the string of rods and the walls of the borehole.

The improvement in the dynamic operating conditions of the borehole makes it possible to improve the control and adjustment of the path of the borehole.

The use, in combination with the variable profiles according to the invention, of a profile for activating the drilling fluid and cleaning the borehole, according to French patent 97/03207, makes it possible not only to obtain the advantages specific to the known profile, that is to say to reduce the pressure drops in the annulus of the borehole, to clean the areas of sedimentation of the borehole and to remove the debris, but also makes it possible to obtain the advantages associated with combining the known profile with the profiles according to the invention. These advantages are due, in particular, to the activation of the flow of the drilling fluid upstream of the profiles according to the invention.

The invention is not restricted to the embodiments which have been described.

It is possible to provide profiles according to the invention as described hereinabove in any number and associated in various ways on the external surface parts of drilling equipment of any type whatsoever.

Such profiles may be provided on various elements of the drill rod string such as connecting pieces, drill collars or any other element habitually used in rotary drilling.

The profiles according to the invention may exhibit geometrical characteristics which differ from those described, in order to fulfil functions which differ from those of a hydrodynamic bearing or of a device that facilitates the extraction of the drilling equipment. In general, the profiled element according to the invention which allows forces exerted in the longitudinal axial direction to be converted into forces or action of circumferential direction allows numerous functions to be obtained, depending on the particular embodiment of the ribs and grooves of the profiled elements.

In the case of profiled parts including grooves the cross section of which decreases in the direction of flow of the drilling fluid, these grooves may have widths or depths which decrease or alternatively may simultaneously have widths and depths which decrease.

The invention applies in general to any rotary drilling equipment exhibiting a cylindrical overall shape, generally of variable diameter, that is to say which has an external surface the envelope of which is a cylinder, the axis of which is the axis of the rotary drilling.

What is claimed is:

1. A profiled element for rotary drilling equipment (1), exhibiting a cylindrical overall shape and an axis (4) directed along an axis of rotation of drilling and parts (15, 20) which project and parts (16, 19) which are recessed in radial directions on its external surface, in arrangements which are roughly in the shape of helixes having an axis that is the axis of rotation (4) of the drilling equipment (1), characterized in that, over at least part of the length of the element (3) in the axial direction, at least one of the geometric and dimensional characteristics of the recessed parts (13, 16) and of the radial projecting parts (15, 20) varies in the axial direction (4) of the element (3);

said element constituting a profiled portion of the drilling equipment (1), and further characterized in that the profiled portion (3) includes a variable profiled part (12) having radial projecting ribs (20) arranged in helixes having an inclination, with respect to a plane of transverse cross section of the drilling equipment at right angles to the axis (4) of the equipment (1), which increases in the axial direction (4) of the drill rod and from the bottom upwards, when the drilling equipment (1) is in the drilling position; and further characterized in that at least one profiled portion (3) of the drilling equipment comprises, upstream of the variable profiled part (11, 12) in the direction of flow of the drilling fluid, a profiled part of uniform cross section (10) including first grooves (13) arranged in helixes having an axis that is the axis (4) of the drilling equipment, allowing the flow of the drilling fluid to be activated.

2. The profiled element according to claim 1, characterized in that second grooves (16) of decreasing cross section of the variable profiled part (11) are arranged in a continuation of the first grooves (13) for activating the flow of the drilling fluid in the profiled part of uniform cross section (10).

3. A drill rod of a rotary drill rod string having a cylindrical overall shape, an axis (4) directed along an axis of rotation for drilling, and end parts (2*a*, 2*b*) for connecting respectively to a second and to a third drill rod of the drill rod string, said drill rod further comprising between said end parts (2*a*, 2*b*), at least one profiled portion (3) having, over at least part of its length, parts (15, 20) which project and parts (13, 16) which are recessed on its external surface, in arrangements which are roughly in the shape of helixes having an axis that is the axis (4) of the drill rod, at least one of the geometric and dimensional characteristics of the recessed parts and of the radial projecting parts (15, 20, 13, 16) being variable in the direction of the axis (4) of the drill rod (1), wherein the profiled portion (3) of the drill rod (1) has an axially variable profiled part (11) having first grooves (16) the cross section of which decreases in a direction (9) of flow of a drilling fluid in an annulus (8) between the drill rod, in a service position in a borehole (6), and the wall of the borehole (6), and wherein the profiled portion (3) additionally includes, upstream of the variable profiled part (11) including the first grooves (16) of decreasing cross section in the direction of flow of the drilling fluid, a profiled part of uniform cross section (10) comprising second grooves (13) arranged in helixes, to allow the flow of the drilling fluid in the annulus (8) to be activated.

4. The drill rod according to claim 3, characterized in that said drill rod includes a variable profiled part (12) exhibiting radial projecting parts or ribs (20) arranged in helixes having an inclination, with respect to a transverse plane perpendicular to the axis (4) of the drill rod, which increases in the axial direction (4) of the drill rod and in a direction from the bottom upwards when the drill rod (1) is in the drilling position inside a borehole (6), the ribs (20) of the profiled part (12) making the drill rod easier to extract from the borehole (6) by the sliding of projecting obstacles (21) on the wall of the borehole (6) inside grooves (19) delimited by the ribs (20) and by the twisting of the rod (1) about its axis (4).

5. The drill rod according to claim 3, characterized in that the variable profiled part (11) including the first grooves (16) of decreasing transverse cross section constitutes apart of the drill rod (1) with maximum diameter.

6. The drill rod according to claim 3, characterized in that the end parts (2*a*, 2*b*) of the drill rod each comprise a first part (23*a*, 23*b*) of smaller diameter including threaded means (25) of connection of the drill rod (1) and, in the axial continuation of the first smaller-diameter part (23*a*, 23*b*), a second larger-diameter part (24*a*, 24*b*).

7. The drill rod according to claim 6, characterized in that the second larger-diameter part (24*a*, 24*b*) of the end part of the drill rod (1) exhibits grooves arranged in helixes having an axis that is the axis (4) of the drill rod (1), of which the transverse cross section perpendicular to the axis (4) of the drill rod decreases in the direction of flow of a drilling fluid while the drill rod (1) is in use inside a borehole (6).

8. The drill rod according to claim 3, characterized in that said drill rod includes, arranged adjacent to its lower connection end part (26) in the position of use inside a borehole (6), a profiled part including projecting ribs arranged in helixes of which the inclination, with respect to a transverse plane perpendicular to the axis (4) of the drill rod (1), increases in the direction of the axis (4) of the drill rod and in the direction from the bottom upwards when the drill rod (1) is in the position of use.

9. The drill rod according to claim 3, characterized in that, between said end parts (2*a*, 2*b*), there is a plurality of profiled portions (3).

10. The drill rod according to claim 9, characterized in that said drill rod includes three profiled portions (3) between said end parts (2*a*, 2*b*).

11. A drill rod of a rotary drill rod string having a cylindrical overall shape, an axis, directed along an axis of rotation for drilling a borehole, and end parts for connecting respectively to a second and a third drill rod of the drill rod string, and further comprising, between said end parts, at least one profiled portion having, on an external surface in a bearing section of maximum diameter extending along at least part of a length of the profiled portion, a plurality of projecting parts and first grooves generally arranged along helixes wound around said axis of the drill rod, said first grooves having a cross-section which decreases in a direction of flow of a drilling fluid in an annulus between the drill rod, in a service position in the borehole, and a wall of the borehole.

12. The drill rod according to claim 11, wherein said profiled portion further comprises, at least upstream of the bearing section of maximum diameter, a cleaning section having a substantially uniform cross-section and second grooves, arranged along helixes wound around the drill rod axis, to allow the flow of the drilling fluid in the annulus to be activated.

13. The drill rod according to claim 12, wherein said profiled portion further comprises a twisting section having radially projecting ribs arranged along helixes wound around the drill rod axis, said helixes having an inclination, with respect to a transverse plane perpendicular to the drill rod axis, which increases in the direction from the bottom of the borehole upwards when the drill rod is in a drilling position in the borehole, said ribs making the drill rod easier to extract from the borehole by the sliding of projecting obstacles on the wall of the borehole inside grooves delimited by the ribs and by twisting of the drill rod about its axis.

14. The drill rod according to any one of claims 11 to 13, wherein each of said end parts comprises a first part and a second part successively in the direction of the axis of the drill rod from extremities of the drill rod, said first part including threaded means for connection of the drill rod, and said second part having a diameter which is larger than the diameter of the first part and which is substantially equal to said maximum diameter of said drill rod in said bearing section.

15. The drill rod according to claim 14, wherein said second larger-diameter part of the end part of the drill rod has grooves arranged along helixes which are wound around the axis of the drill rod, and which have a transverse cross section, perpendicular to the axis of the drill rod, that decreases in the direction of flow of the drilling fluid around the drill rod in use inside the borehole.

16. The drill rod according to any one of claims 11 to 13, further comprising, arranged adjacent to its lower connection end part in the position of use of the drill rod inside a borehole, a profiled part including projecting ribs arranged in helixes of which the inclination with respect to a transverse plane perpendicular to the axis of the drill rod increases in the direction of the axis of the drill rod and in the direction from the bottom upwards when the drill rod is in the position of use.

17. The drill rod according to any one of claims 11 to 13, comprising a plurality of profiled portions between the connection end parts.

18. The drill rod according to claim 17, comprising three profiled portions between the connection end parts.

* * * * *

UNITED STATES PATENT AND TRADEMARK OFFICE

CERTIFICATE OF CORRECTION

PATENT NO. : 6,349,779 B1
DATED : February 26, 2002
INVENTOR(S) : Jean Gilbert Boulet It is certified that error appears in the above-identified patent and that said Letters Patent is hereby corrected as shown below:

Title page,
Item [75], Inventor, the inventor's name should read as follows:

-- [75] Inventor: Jean Gilbert Boulet --.

Signed and Sealed this

Fifteenth Day of April, 2003

JAMES E. ROGAN
*Director of the United States Patent and Trademark Office*